US010847919B2

(12) United States Patent
Li

(10) Patent No.: US 10,847,919 B2
(45) Date of Patent: Nov. 24, 2020

(54) ELECTRICAL OUTLET SAFETY DEVICE

(71) Applicant: Haoxun Li, Orlando, FL (US)

(72) Inventor: Haoxun Li, Orlando, FL (US)

( * ) Notice: Subject to any disclaimer, the term of this patent is extended or adjusted under 35 U.S.C. 154(b) by 0 days.

(21) Appl. No.: 16/521,012

(22) Filed: Jul. 24, 2019

(65) Prior Publication Data

US 2020/0194922 A1 Jun. 18, 2020

Related U.S. Application Data

(60) Provisional application No. 62/778,926, filed on Dec. 13, 2018.

(51) Int. Cl.
*H01R 13/453* (2006.01)
*H01R 25/00* (2006.01)

(52) U.S. Cl.
CPC ..... *H01R 13/453* (2013.01); *H01R 25/006* (2013.01)

(58) Field of Classification Search
CPC ..... H01R 13/453; H01R 25/006
See application file for complete search history.

(56) References Cited

U.S. PATENT DOCUMENTS 4,640,564 A * 2/1987 Hill ..... H01R 13/447 439/137
4,952,755 A * 8/1990 Engel ..... H01R 13/447 174/67
5,449,860 A * 9/1995 Buckshaw ..... H02G 3/14 174/67
7,098,403 B2 * 8/2006 Jolley ..... H02G 3/14 174/66
7,967,620 B1 6/2011 Baldwin et al.
9,379,474 B1 6/2016 McGowan, Jr.
2011/0104918 A1 * 5/2011 Chen ..... H01R 13/4534 439/136
2012/0287572 A1 * 11/2012 Huang ..... H01R 13/4534 361/679.58
2013/0278361 A1 * 10/2013 Weeks ..... H01R 13/713 335/6
2014/0065862 A1 * 3/2014 Tomimbang ..... H01R 24/30 439/140
2016/0104961 A1 * 4/2016 Savicki, Jr. ..... H01R 13/68 439/138
2017/0187138 A1 * 6/2017 Lin ..... H01R 13/4534
2018/0316145 A1 * 11/2018 McKiernan ..... H01R 25/006
2020/0144763 A1 * 5/2020 Lee ..... H01R 13/18

* cited by examiner

*Primary Examiner* — Truc T Nguyen
(74) *Attorney, Agent, or Firm* — Jason T. Daniel, Esq.; Daniel Law Offices, P.A.

(57) ABSTRACT

An electrical outlet safety device includes a main body having electrical and ground contacts for receiving electrical current. At least one receptacle having a pair of electric slots and a ground aperture for receiving the prongs of an electric plug are provided along the front wall. A plurality of channels is disposed along the inside surface of the front wall for receiving a generally T-shaped safety tab. The tab is positioned within the channels and maintained in a closed position by a spring wherein the body of the tab obstructs the slots and aperture. Insertion of two prongs from an electric plug moves the tab from the closed position to the open position whereby the prongs are able to connect to internal circuitry to receive electrical current from the electrical source.

9 Claims, 4 Drawing Sheets

ELECTRICAL OUTLET SAFETY DEVICE

CROSS-REFERENCE TO RELATED APPLICATIONS

This application claims the benefit of U.S. Application Ser. No. 62/778,926 filed on Dec. 13, 2018, the contents of which are incorporated herein by reference.

TECHNICAL FIELD

The following disclosure contemplates various embodiments of a safety device that provides protection when engaging an electrical outlet.

BACKGROUND OF THE INVENTION

Many residential and commercial buildings include one or more electrical outlets. While electrical outlets may provide a convenient and easy way for electrical customers to access an electrical supply, their easy accessibility may pose risks to children or others who attempt to insert items other than an appropriate electrical plug into an electrical outlet.

Although there are many known types of safety outlets that are designed to reduce this danger, most of these devices are difficult to use, and often become broken quickly after being installed.

The present invention directed to an electrical outlet plug protection device differs from the conventional art in several aspects. The manner by which will become more apparent in the description which follows, particularly when read in conjunction with the accompanying drawings and illustrations.

SUMMARY OF THE INVENTION

The present invention is directed to an electrical outlet safety device. One embodiment of the present invention can include a main body having a plurality of walls that define a hollow interior space. The main body can be sized for inclusion within an electrical supply box so as to be permanently mounted to a wall of a building structure. Electrical and ground contacts can be disposed along the main body and can be connected to the building electric supply to receive electrical current therefrom.

The outlet can include at least one receptacle having a pair of electric slots and a ground aperture. The slots and aperture including a shape and size that is complementary to the shape and size of the prongs of an electric plug.

A plurality of channels is disposed along the inside surface of the front wall for receiving a generally T-shaped safety tab. The tab is positioned within the channels and maintained in a closed position by a spring wherein the body of the tab obstructs the slots and aperture. Insertion of two prongs from an electric plug moves the tab from the closed position to the open position whereby the prongs are able to connect to internal circuitry to receive electrical current from the electrical source.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
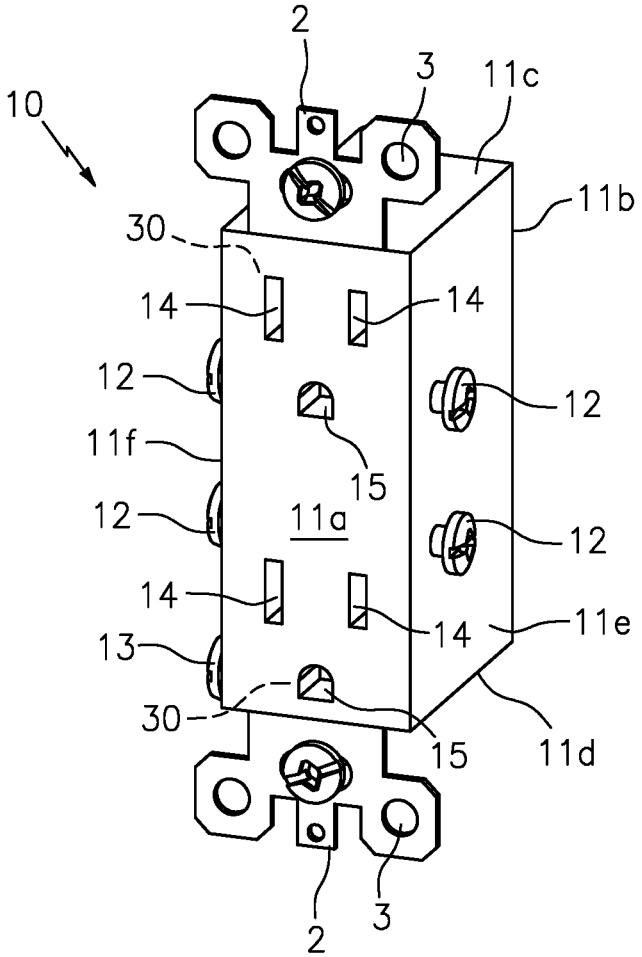
FIG. 1 is a perspective view of the electrical outlet safety device that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

FIGS. 1-5 illustrate various embodiments of an electrical outlet safety device 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown best at FIG. 1, one embodiment of the outlet 10 can include a main body 11 having a generally rectangular shaped element having a shape and size that conforms to a traditional electrical outlet. The body can include any number of brackets 2 and holes 3 for receiving hardware to allow the device to be secured within an electrical housing that is permanently mounted into a building wall or structure and/or to receive a faceplate. To this end, the main body 11 can preferably be constructed from electrically nonconductive plastic and can include a front wall 11*a*, a back wall 11*b*, a top wall 11*c*, a bottom wall 11*d* and a pair of side walls 11*e* and 11*f* that define a generally hollow interior space.

Figure 5:
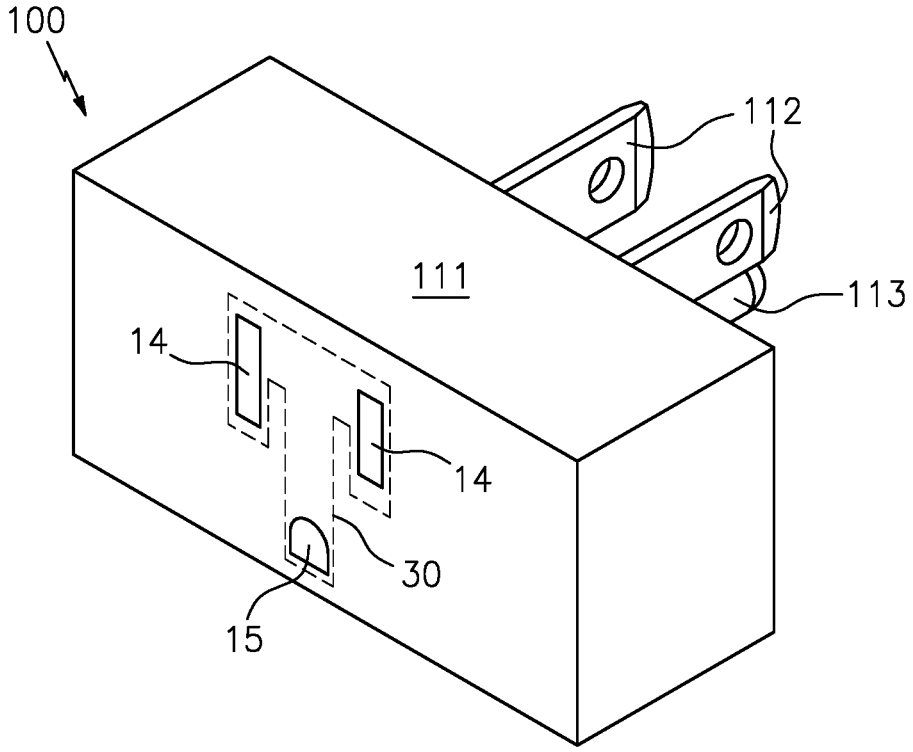
FIG. 5 is a perspective view of the electrical outlet safety device, in accordance with one embodiment of the invention.

Of course, the main body is not limited to any particular shape, size or construction materials, as other embodiments having any number of different shapes, sizes and construction materials that are suitable for housing electrical outlet components are also contemplated (See FIG. 5).

A plurality of electrical contacts 12 and a ground contact 13 can be positioned along the exterior sides 11*e*-11*f* and/or back 11*b* of the main body 11. The contacts and ground terminal may include hardware such as metallic screws or quick connect wire couplers for engaging electrical and ground supply wiring within the structure.

Although not specifically illustrated, electrical components and circuitry positioned within the main body 11 are in communication with the contacts 12-13 to facilitate the transfer of ground and electrical power from the supply wiring to the prongs of an electric plug is plugged in to the main body 11. These components may also include ground fault interrupt circuits (GFCI) having a switch that can be positioned along the front wall 11*a* of the main body. Those of skill in the art will readily understand how to adapt the teachings of this disclosure relating to the use of a moveable safety tab to the face of an electrical outlet with an otherwise conventional outlet and GFCI outlet design. Therefore, no further description is provided.

As shown, the device 10 can include at least one (and preferably two) receptacles each having a pair of elongated apertures/slots 14 and a generally circular aperture 15 that extend through the front wall 11*a* of the main body. The slots and aperture each include a shape, size and orientation that is complementary to the shape, size and orientation of an electric plug for which the outlet is designed to receive. Although illustrated with regard to an American style plug and receptacle, the illustrative concepts disclosed herein may be readily adapted for use by other types or styles of electrical systems without undue experimentation. Accordingly, the device 10 is not limited to this configuration.

In either instance, the slots 14 are configured to receive the electrical terminals of an electric cord which will engage circuitry positioned within the main body to receive electrical power that passes through the electric contacts 12. Likewise, the aperture 15 is configured to receive a grounding terminal extending from the electrical plug which will engage the internal circuitry to be connected with the ground contact 13.

Figure 2:
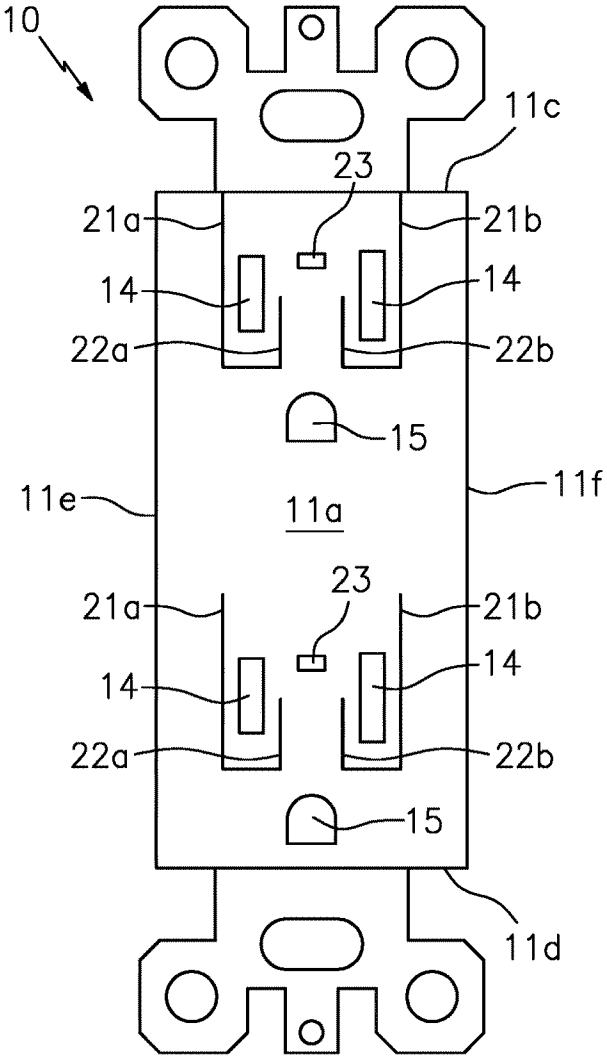
FIG. 2 is a cutaway view of the inside portion of the front wall of the electrical outlet safety device, in accordance with one embodiment of the invention.

As shown best at FIG. 2, the inside facing surface of the front wall 11*a* of the main body can include a first/outer set of guide channels 21*a* and 21*b* that are positioned adjacent to the outside edges of the slots 14, a second/inner set of guide channels 22*a* and 22*b* that are positioned adjacent to the inside edges of the slots 14, and a protrusion 23 that is positioned between the slots 14. The channels and protrusions extending outward from the surface so as to function as a guide for engaging, aligning and facilitating movement of the below described safety tab 30.

Figure 3B:
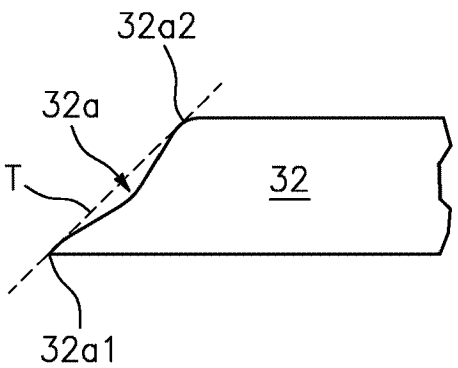
FIG. 3B is a partial cutout side view of the safety tab of FIG. 3A, in accordance with one embodiment of the invention.
Figure 3A:
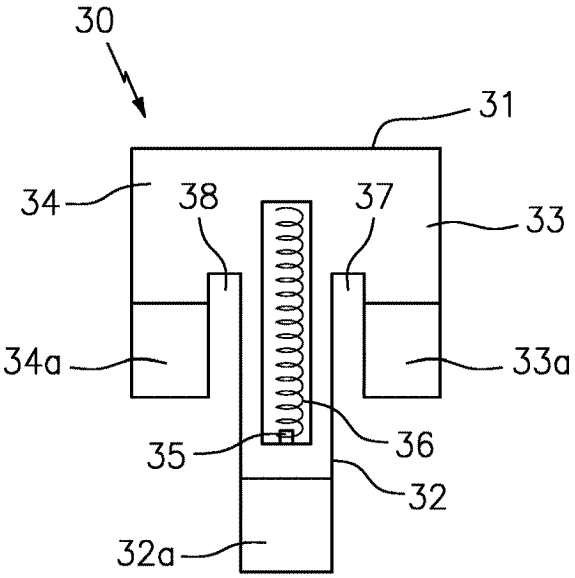
FIG. 3A is front view of the safety tab of the electrical outlet safety device, in accordance with one embodiment of the invention.

FIG. 3A, illustrates one embodiment of a sliding safety tab 30. As shown, the tab can include a generally T-shaped member having a top end 31, an elongated central section 32, and a pair of side sections 33 and 34. An aperture 35 is positioned along the central section for housing a spring 36, and a pair of grooves 37 and 38 are located adjacent to the aperture between the central section and the pair of sides.

The bottom end 32*a* of the central section and the bottom ends of the side sections 33*a* and 34*a* can each include a tapered/angled portion extending along the front surface. To this end, the angled portions 33*a*, 34*a* and/or 32*a* can include any combination of straight-angled or curvilinear surfaces of between approximately 25 and 60 degrees.

For example, FIG. 3B illustrates one preferred embodiment wherein the angled portion 32*a* includes a curvilinear surface having an overall angle of approximately 45 degrees (see tangent line T) extending from the distal end of the surface 32*al* to the proximal end of the surface 32*a*2. In the preferred embodiment, angled portions 33*a* and 34*a* can include identical shapes and angles.

The curvilinear surface combined with the tangent angle of 45 degrees is specifically chosen to allow each angled surface 32*a*, 33*a* and 34*a* to receive the linear (pushing) force applied by the prongs of an electrical cord, and to transition this force into vertical movement of the safety tab 30.

Figure 4B:
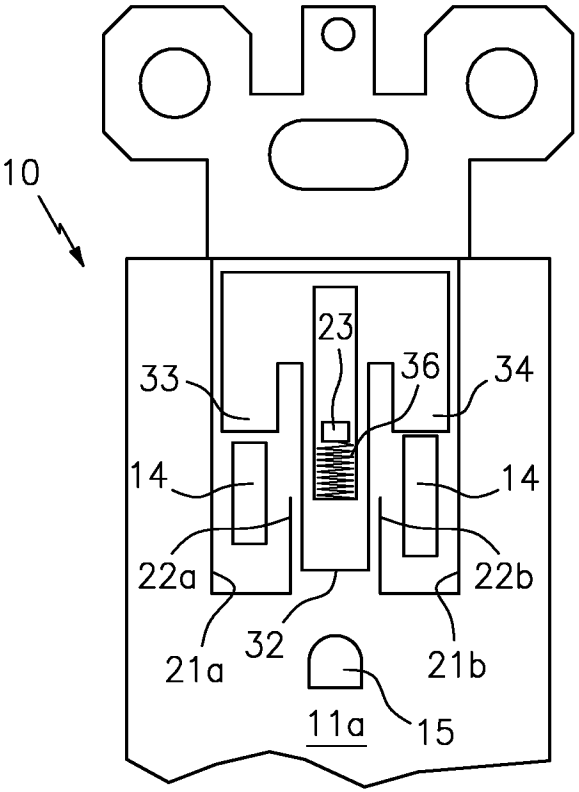
FIG. 4B is a partial cutaway view of the electrical outlet safety device in the open position, in accordance with one embodiment of the invention.
Figure 4A:
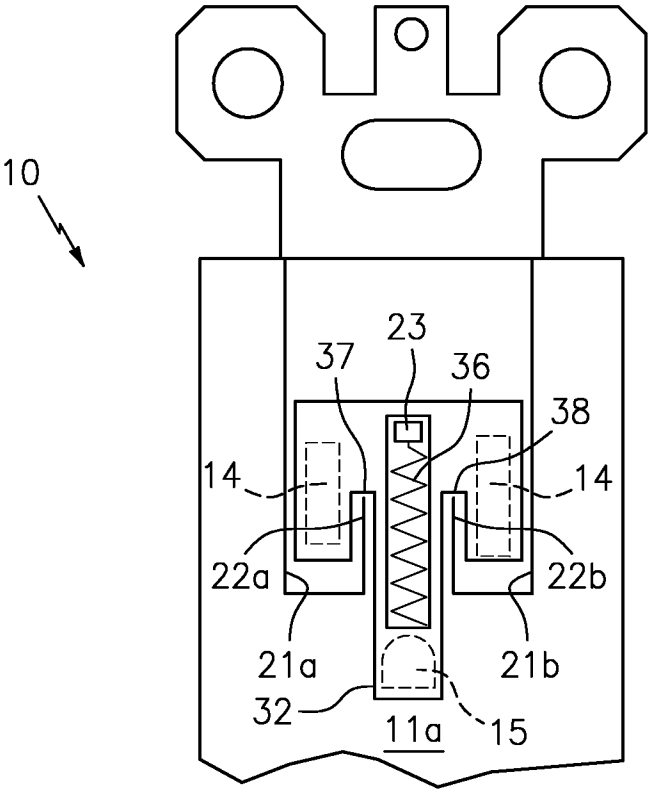
FIG. 4A is a partial cutaway view of the electrical outlet safety device in the closed position, in accordance with one embodiment of the invention.

As shown in FIGS. 4A and 4B, the safety tab 30 can be positioned wherein the tapered surfaces 32*a*, 33*a*, and 34*a* are positioned against the inside surface of the front wall 11 at locations directly behind the ground aperture 15 and terminal slots 14, respectively. When so positioned, the outer channels 21*a* and 21*b* can engage the outside edges of sides 33 and 34, respectively, the inner channels 22*a* and 22*b* can be positioned within the grooves 37 and 38, respectively, and the protrusion 23 can be located within the central aperture 35 of the tab, with the top end of the spring 36 making contact with the bottom end of the protrusion 23.

This arrangement allows the tab 30 to slide between the closed position shown at FIG. 4A where the slots 14 and ground aperture 15 are obstructed, and the open position shown at FIG. 4B where the slots 14 and ground aperture 15 are unobstructed by the tab. Additionally, owing to the arrangement of the spring 36 and protrusion 23, the tab 30 is biased into the closed position. Although not illustrated, an optional panel or other retaining mechanism may be positioned within the housing to prevent separation and/or movement of the tab relative to the front panel in any manner other than that described above.

In operation, the device 10 can be attached to a structure and connected to the electrical supply wiring in conventional fashion. While resting, the safety tab 30 is positioned so as to obstruct the slots 14 and ground aperture 15, thereby preventing insertion of foreign objects into any one of the openings.

When the outlet is to be used, a user will align the electric terminals of an electric cord with the slots 14, and push. As noted above, the tab 30 is positioned with the angled sections directly behind the aperture and slots. As such, when the distal end of the electrical terminals make contact with the angled section 33*a* and 34*a* located along both sides of the tab, the evenly distributed pushing force against the angled surfaces will cause the tab to slide upward along the channels 21*a/b* and 22*a/b* until the tab 30 is moved out of the path of the terminals which will then continue past the tab and engage the electrical circuitry. The above process works the same for cords having a ground terminal, as the ground terminal will engage the angled section 32*a* of the tab.

In this regard, the design of the system ensures that insertion of an object into only one of the slots 14 will not permit movement of the tab, as the pushing force would not be evenly distributed along both sides of the tab, and thus will preclude the tab from sliding along the channels 21*a/b* and 22*a/b*.

Although described above as an outlet for permanent installation into a wall or structure, other embodiments are also contemplated. To this end, FIG. 5 illustrates another embodiment of the electrical outlet safety device 100 that includes functionality for selectively engaging an existing electrical outlet so as to incorporate the inventive concepts thereto.

As shown, the device 100 can also include a main body 111 that is preferably constructed from electrically nonconductive plastic and having a plurality of walls that define a generally hollow interior space.

In the present embodiment, the above described electrical and ground contacts can include a pair of electrical terminals 112 and a ground terminal 113 that can extend outward from the back wall for insertion into another outlet. Although not specifically illustrated, the electrical terminals can engage electrically conductive sleeves positioned within the housing to conduct the electric and ground potentials onto an electric cord that is positioned through the front surface of the main body. In this regard, the sleeves can function in the same manner as a conventional extension outlet device which are well known in the art, therefore, no further description is provided.

As shown, the device 100 includes at least one receptacle having a pair of elongated slots 14 and ground aperture 15, a series of guide channels (not illustrated) and safety tab 30, which function in the same manner described above to receive the terminals of an electric cord and provide power thereto.

In various embodiments, the device 100 may also include additional circuitry to prevent fire resulting from an electrical overcurrent situation. In this regard, the circuitry may include electronic components such as a processor, memory control board and temperature sensor, for example which can monitor the flow of electricity through the plug and selectively stem the flow of electricity upon detecting a warning situation such as high temperature, high voltage and/or high amperage, for example. The circuitry can also be enabled with a communications module for wireless activation by a user and/or to report alarm conditions.

In either instance, the above described electrical outlet safety device provides an integrated safety system to electric outlets that does not require any additional steps or actions on the part of the user, compared to a traditional outlet.

As described herein, one or more elements of the electrical outlet safety device can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A safety outlet device, comprising:

a main body having a front wall and a plurality of side walls that define an interior space;

a plurality of electrical contacts that are positioned along at least one of the plurality of side walls, said plurality of electrical contacts functioning to receive an electrical current from an electric supply;

at least one receptacle that is positioned along the front wall, each of the at least one receptacle including a pair of slots for receiving a pair of terminals from an electric plug, and a generally circular aperture for receiving a ground terminal from the electric plug;

a protrusion that is positioned along an inside facing surface of the front wall at a location between the pair of slots; and a generally T-shaped safety tab having a pair of side sections, a bottom end, and a central aperture, wherein the protrusion is positioned within the central aperture of the safety tab, and the safety tab is configured to slide vertically between an open position and a closed position.

2. The device of claim 1, wherein in the closed position, the side sections of the safety tab obstruct the pair of slots, and the bottom end of the safety tab obstructs the circular aperture, and in the open position, the side sections of the safety tab do not obstruct the pair of slots, and the bottom end of the safety tab does not obstruct circular aperture.

3. The device of claim 1, further comprising:

a spring that is positioned within the central aperture of the safety tab, said spring having a first end that is connected to the protrusion on the inside surface of the front wall, said spring functioning to maintain the safety tab in the closed position at rest.

4. The device of claim 1, wherein each of the pair of side sections and the bottom end of the safety tab include an angled surface that is positioned against the inside surface of the front wall, wherein the angled surface of each of the pair of side sections and the bottom end are configured to be engaged by a terminal from an electric plug to move the safety tab to the open position.

5. The device of claim 1, wherein the main body includes a generally rectangular shape having two receptacles.

6. The device of claim 5, further comprising a plurality of mounting brackets and holes that are positioned along the main body for permanently engaging a housing that is attached to a structure.

7. The device of claim 6, wherein the plurality of electrical contacts include functionality for engaging an electrical wire from the housing.

8. The device of claim 1, wherein the plurality of electrical contacts comprises a pair of electrical terminals and a ground terminal that extend outward from a back wall of the main body.

9. The device of claim 1, wherein each of the pair of side sections and the bottom end of the safety tab include a curvilinear surface that is positioned against the inside surface of the front wall, wherein the curvilinear surface of each of the pair of side sections and the bottom end are configured to be engaged by a terminal from an electric plug to move the safety tab from the closed position to the open position.

* * * * *